United States Patent [19]

Nakao et al.

[11] 4,359,865

[45] Nov. 23, 1982

[54] EXHAUST SYSTEM FOR MULTICYLINDER MOTORBIKE ENGINE

[75] Inventors: Yasuo Nakao, Iwata; Nobuo Norimatsu, Toyooka, both of Japan

[73] Assignee: Yamaha Hatsudoki Kabushiki Kaisha, Iwata, Japan

[21] Appl. No.: 182,113

[22] Filed: Aug. 28, 1980

[30] Foreign Application Priority Data

Aug. 31, 1979 [JP] Japan ..... 54-112153

[51] Int. Cl.[3] ..... F01N 7/08

[52] U.S. Cl. ..... 60/313; 60/323; 180/219; 181/238; 181/240

[58] Field of Search ..... 60/312, 313, 323, 324; 181/238, 239, 240; 180/225, 228, 219

[56] References Cited

U.S. PATENT DOCUMENTS

| | | | |
|---|---|---|---|
| 2,194,928 | 3/1940 | Doyle | 123/52 M |
| 2,990,028 | 6/1961 | Powers | 181/238 |
| 3,189,122 | 6/1965 | Martin | 60/323 |
| 3,420,052 | 1/1969 | Miller | 60/313 |
| 3,516,247 | 6/1970 | Knox | 60/324 |
| 3,545,414 | 12/1970 | Thompson | 60/323 |
| 3,794,139 | 2/1974 | Hetherington | 181/238 |
| 3,949,829 | 4/1976 | Honda | 180/225 |

*Primary Examiner*—Douglas Hart
*Attorney, Agent, or Firm*—Donald D. Mon

[57] ABSTRACT

An exhaust system for a multicylinder motorbike internal combustion engine. Each cylinder has a respective exhaust pipe. The pipes merge and discharge into a chamber, from which chamber a plurality of silencers, fewer in number than the cylinders, discharges exhaust gases to the atmosphere.

6 Claims, 6 Drawing Figures

EXHAUST SYSTEM FOR MULTICYLINDER MOTORBIKE ENGINE

FIELD OF THE INVENTION

The present invention relates to an exhaust system for a multi-cylinder internal combustion engine of a motorbike and, more particularly, to a merging structure of exhaust pipes.

BACKGROUND OF THE INVENTION

In the exhaust system of a multi-cylinder internal combustion engine according to the prior art, there has been proposed a structure in which at least two exhaust pipes or silencers are connected or merged midway thereof, with a view to improving the output of the engine and the silencing effect.

Since the motorbike has its exhaust system exposed to the outside, and its mounting space limited in case the aforementioned merging structure is applied to the motorbike, it becomes the more difficult to make the merging structure of the exhaust pipes simple in appearance, especially as the number of the engine cylinders is increased.

In view of the background of the invention thus far described, therefore, it is an object of the invention to provide an exhaust system for a motorbike having a plurality of cylinders which can ensure a simple layout in appearance as well as improvements in engine output and in silencing effect.

BRIEF DESCRIPTION OF THE INVENTION

According to the invention, there is provided an exhaust system of the above type in which there are inserted into an exhaust chamber connected to a plurality of silencers a plurality of exhaust pipes in a larger number than that of said silencers, in which said exhaust pipes are suitably merged, and in which the merged ends are opened into said exhaust chamber.

The exhaust system according to the invention is suitably applied to an internal combustion engine of three or more cylinder type having at least three cylinders and especially suitably applied to an internal combustion engine of four or six cylinder type in view of the balance between the right and left.

The invention will be fully understood from the following detailed description and the accompanying drawings, in which:

DETAILED DESCRIPTION OF THE INVENTION

Figure 1:
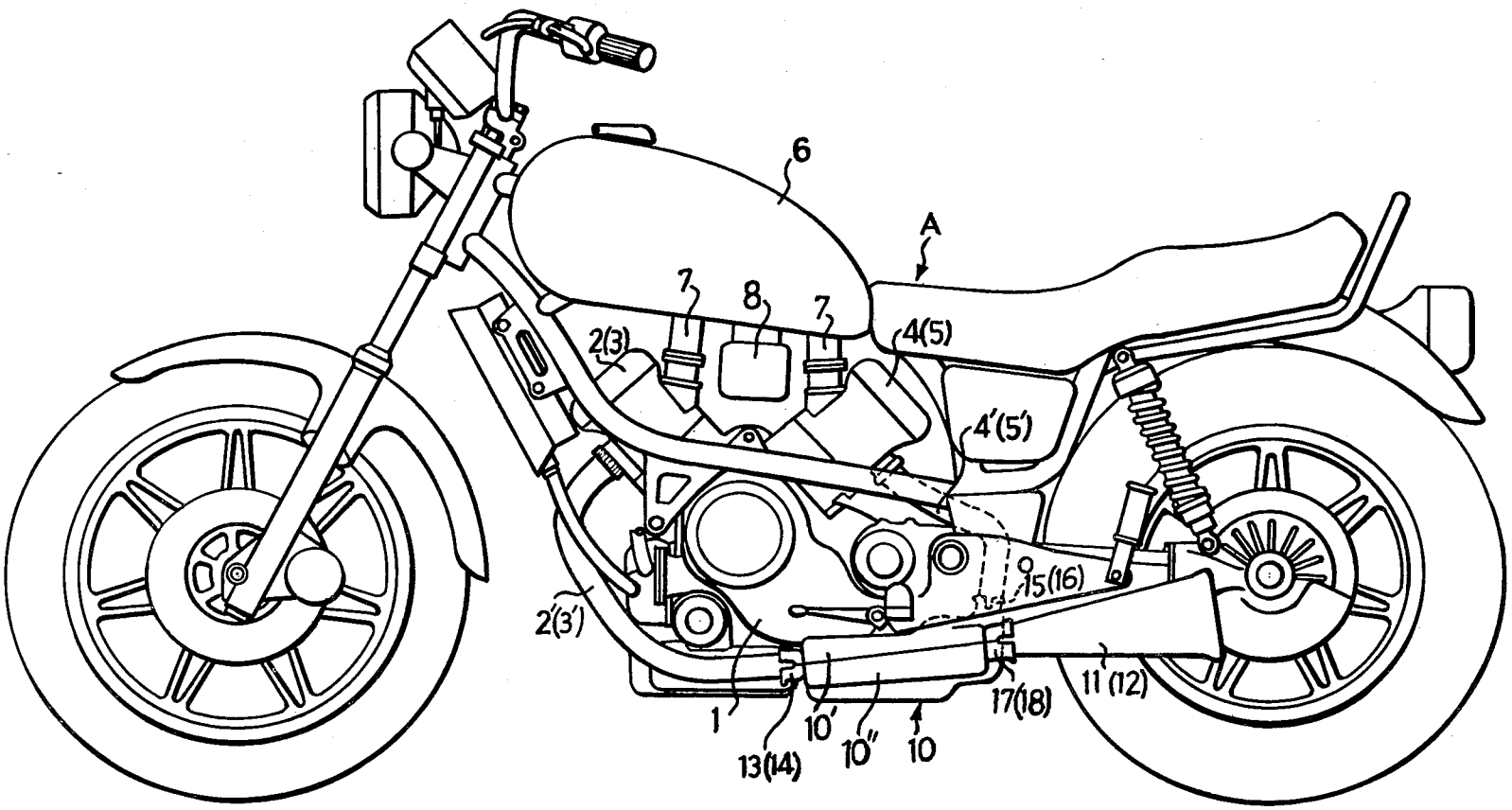
FIG. 1 is a side elevation showing a motorbike which is equipped with a system according to the invention.

The invention will be described in connection with a four-cycle four cylinder engine. In FIG. 1, a motorbike is generally indicated by reference letter A. An engine 1 is equipped with four cylinders 2, 3, 4 and 5. Numerals 2', 3', 4' and 5' indicate exhaust pipes which are connected to the ports of the respective cylinders. A fuel tank 6, an intake pipe 7, an air cleaner 8 an exhaust chamber 10, are shown. Numerals 11 and 12 indicate silencers.

The engine 1 is of the so-called "V-type four-cylinder type", in which two front cylinders 2 and 3 and two rear cylinders 4 and 5 are arranged in the form of a letter "V". The exhaust chamber 10 is disposed below the rear portion of the engine 1.

More specifically, the exhaust chamber 10 is constructed of a generally flattened casing which is composed of upper and lower members 10' and 10'' jointed to each other. Joint sleeves 13 and 14 and joint sleeves 15 and 16 are mounted in a protruding form upon the right and left sides of the front and rear portions of the exhaust chamber 10, respectively. Thus, the aforementioned exhaust pipes 2' and 3' are fitted and jointed at their respective rear ends to said joint sleeves 13 and 14. Likewise, the aforementioned exhaust pipes 4' and 5' are fitted and jointed at their respective rear ends to said joint sleeves 15 and 16.

Moreover, the exhaust chamber 10 has its rear portion protruding at its right and left sides into joint sleeves 17 and 18, respectively, to which are jointed the aforementioned silencers 11 and 12, respectively, to provide communication with the inside of the exhaust chamber 10.

In the exhaust chamber 10, there are arranged two gang pipes 19 and 20.

These gang pipes 19 and 20 are so shaped that two branch pipes 19' and 19'' and two branch pipes 20' and 20'' are merged at a single merging portion 19''' and a single merging portion 20''', respectively. These merging portions 20''' and 19''' are vertically stepwise arranged in the front portion of the chamber 10.

The gang pipe 19 has its respective branch pipes 19' and 19'' curved such that the former pipe 19' is jointed to said joint sleeve 13 and connected to the exhaust pipe 2' and such that the latter pipe 19'' is jointed to said joint sleeve 15 and connected to the exhaust pipe 4'. On the other hand, the gang pipe 20 has its branch pipe 20' jointed to the aforementioned sleeve 14 and connected to the exhaust pipe 3' and its branch pipe 20'' jointed to said sleeve 16 and connected to the exhaust pipe 5'.

As a result, the aforementioned exhaust pipe 2' and 4' are so constructed as to be merged and inserted into the chamber 10 through the gang pipe 19. On the other hand, the exhaust pipes 3' and 5' are so constructed as to be merged and inserted into the chamber 10 through the gang pipe 20.

In order to retain the lengths of the exhaust pipes, the aforementioned respective gang pipes 19 and 20 are made to have their merging portions 19''' and 20''' laterally directed, and with their ends opened into the chamber 10.

The respective cylinders of the engine 1 according to the aforementioned embodiment have the firing order of cylinders 2 - 5 - 4 - 3 and have the phase differences of 90 degrees between the cylinders 2 and 5, 180 degrees between the cylinders 5 and 4, 270 degrees between the cylinders 4 and 3 and 180 degrees between the cylinders 3 and 2.

Figure 4:
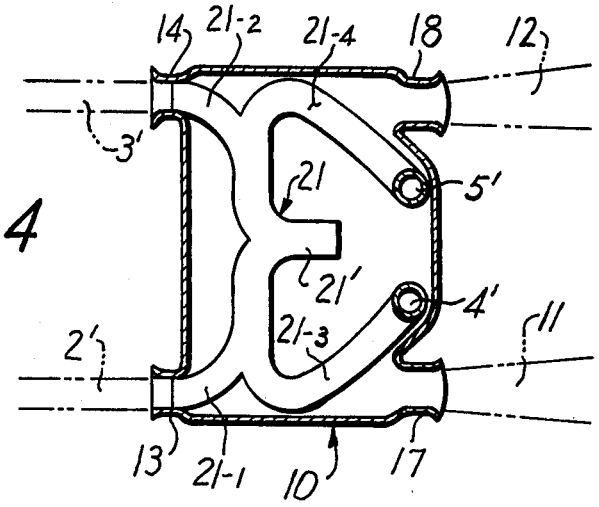
FIGS. 4 to 6 are sectional top plan views showing other embodiments of the invention.
Figure 5:
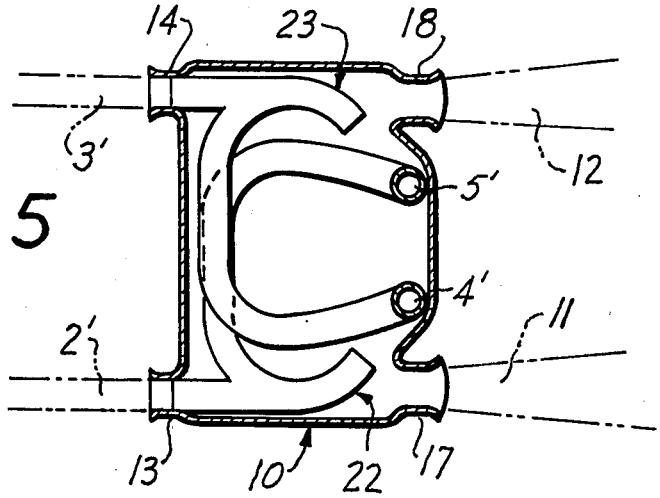
Figure 6:
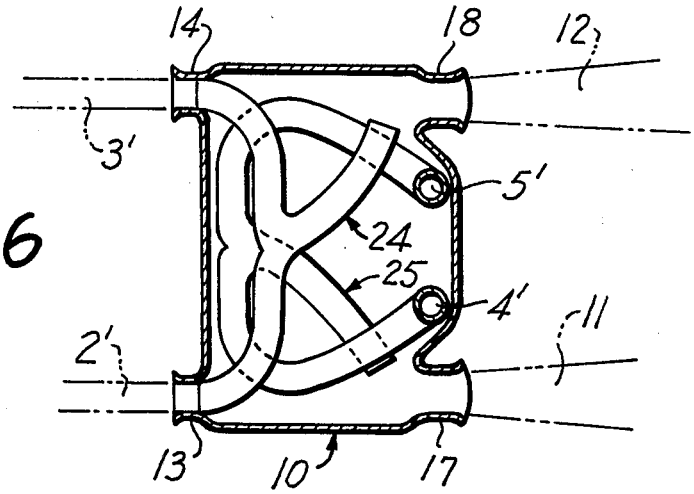

FIGS. 4 to 6 show other embodiments of the invention, i.e., the modifications of the gang pipes.

In FIG. 4, a gang pipe 21 has such a shape as is composed of four branch pipes 21-1, 21-2, 21-3 and 21-4 and one merging portion 21' such that the respective branch pipes are connected to the exhaust pipes 2', 3', 4' and 5', respectively.

In other words, the embodiment shown in FIG. 4 is so constructed that the four exhaust pipes 2', 3', 4' and 5' are merged into one within the chamber 10.

Figure 2:
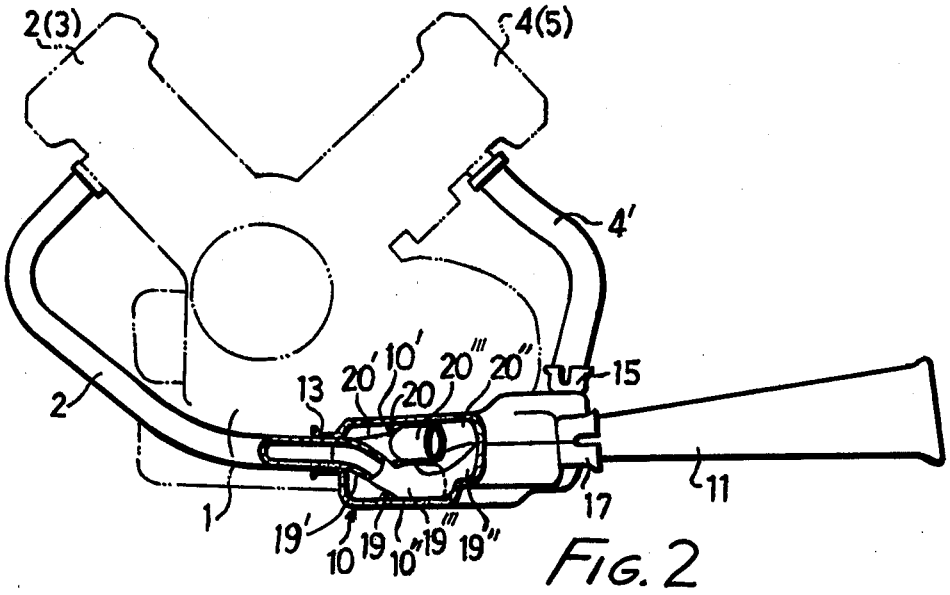
FIG. 2 is an enlarged side elevation of a portion of FIG. 1.
Figure 3:
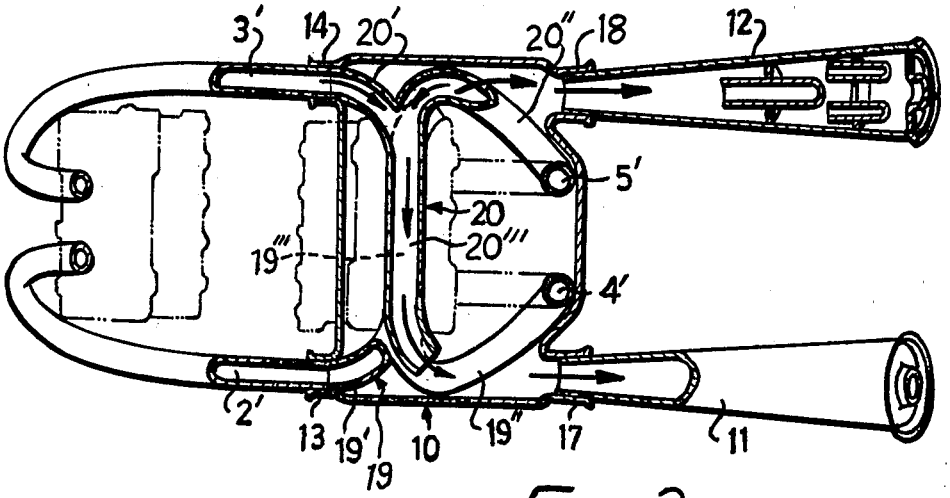
FIG. 3 is a horizontal section of FIG. 2.

FIGS. 5 and 6 are directed to other embodiments, in which the connecting positions of the gang pipes in the embodiment shown in FIGS. 1 to 3 are modified. In FIG. 5, a gang pipe 22 is connected to the exhaust pipes 2' and 5' while merging the two, and a gang pipe 23 merges the exhaust pipes 3' and 4'. On the other hand, the embodiment shown in FIG. 6 is so constructed that the exhaust pipes 2' and 3' are merged by means of a gang pipe 24 whereas the exhaust pipes 4' and 5' are merged by means of a gang pipe 25.

As has been described herein before, according to the present invention, since the plural exhaust pipes are merged within the exhaust chamber, the merging portions, in which the pipe components are complexly curved, are inside the chamber so that they cannot be seen from the outside, and the exhaust chamber itself is compactly accommodated in a narrow space such as that below the engine, thus providing an exhaust system which is simple in appearance.

Since the aforementioned plural exhaust pipes are merged, the pulsating waves of the exhaust gases in each exhaust pipe exerts useful influences upon the cylinder at the side of another exhaust pipe so that the improvement in the output generation of the engine can be maintained. Also, since the merged ends of the plural exhaust pipes are opened into the exhaust chamber and since the plural silencers are connected to that chamber, the exhaust gases discharged into the chamber are always distributed into the plural silencers so that the improvement in the silencing effect can also be maintained.

The invention is not to be limited by the embodiments shown in the drawings and described in the description, which are given by way of example and not of limitation, but only in accordance with the scope of the appended claims.

We claim:

1. An exhaust system for a multi-cylinder internal combustion engine for a motorbike, comprising: a plurality of exhaust pipes equal in number to the number of cylinders extending from respective ones of said cylinders; an exhaust chamber formed in a casing, said casing having an entry opening for each of said exhaust pipes, said exhaust pipes, in pairs, being convergently joined to form a gang pipe which continues the flow of each said pair of exhaust pipes and discharges into said exhaust chamber, said exhaust pipes and gang pipe having a substantial length inside said exhaust chamber; and a silencer in communication with said exhaust chamber to exhaust gases therefrom, there being a greater number of exhaust pipes than silencers.

2. An exhaust system according to claim 1 in which two pairs of exhaust pipes are merged into respective gang pipes, one gang pipe for each said pair, and in which two silencers are provided.

3. An exhaust system according to claim 2 in which said gang pipes discharge separately, at spaced apart locations, into said exhaust chamber.

4. An exhaust pipe according to claim 2 in which one exhaust pipe of each pair is connected to a cylinder of one bank of said engine, and the other exhaust pipe of each pair is connected to a cylinder of another bank.

5. An exhaust system according to claim 1 in which all exhaust pipes are merged into a single gang pipe which is disposed in, and discharges into, said exhaust chamber.

6. An exhaust system according to claim 5 in which at least four pipes and two silencers are provided.

* * * * *